US006687913B2

(12) United States Patent
Aldridge

(10) Patent No.: US 6,687,913 B2
(45) Date of Patent: Feb. 10, 2004

(54) HAZARDOUS DUTY GARMENT WITH SEPARABLE MOISTURE BARRIER AND THERMAL BARRIER

(75) Inventor: Donald Aldridge, New Carlisle, OH (US)

(73) Assignee: Lion Apparel, Inc., Dayton, OH (US)

( * ) Notice: Subject to any disclaimer, the term of this patent is extended or adjusted under 35 U.S.C. 154(b) by 17 days.

(21) Appl. No.: 10/015,363

(22) Filed: Dec. 13, 2001

(65) Prior Publication Data

US 2003/0110553 A1 Jun. 19, 2003

(51) Int. Cl.[7] ..... A41D 1/00
(52) U.S. Cl. ..... 2/81; 2/97; 2/272
(58) Field of Search ..... 2/81, 82, 85, 87, 2/93, 97, 98, 125, 457, 458, 272; 24/306

(56) References Cited

U.S. PATENT DOCUMENTS

| | | | | |
|---|---|---|---|---|
| 3,403,429 A | * | 10/1968 | Smith | 24/306 |
| 3,829,901 A | | 8/1974 | Massetti et al. | 2/97 |
| 4,502,153 A | | 3/1985 | Lapedes et al. | |
| 4,507,806 A | | 4/1985 | Coombs | 2/85 |
| 4,604,759 A | | 8/1986 | Bowman et al. | 2/81 |
| 4,748,691 A | | 6/1988 | Grilliot et al. | 2/81 |
| 4,768,233 A | | 9/1988 | Grilliot et al. | |
| 4,999,850 A | | 3/1991 | Grilliot et al. | 2/97 |
| 5,136,723 A | | 8/1992 | Aldridge et al. | |
| 5,189,737 A | | 3/1993 | Ribicic | |
| 5,208,919 A | | 5/1993 | Fields | 2/81 |
| 5,274,850 A | | 1/1994 | Aldridge | 2/81 |
| 5,349,705 A | | 9/1994 | Ragan | 2/161.6 |
| 5,542,124 A | | 8/1996 | Grilliot et al. | 2/81 |
| 5,655,222 A | | 8/1997 | Grilliot et al. | 2/81 |
| 5,697,101 A | | 12/1997 | Aldridge | 2/81 |
| 5,720,045 A | | 2/1998 | Aldridge | 2/81 |
| 5,860,163 A | | 1/1999 | Aldridge | 2/81 |
| 5,884,332 A | | 3/1999 | Snedeker | 2/81 |
| 5,920,905 A | | 7/1999 | Aldridge | |
| 5,924,134 A | | 7/1999 | Taylor et al. | 2/81 |
| 5,933,865 A | * | 8/1999 | Aldridge | 2/81 |
| 6,339,843 B1 | | 1/2002 | Grilliot et al. | 2/97 |

* cited by examiner

*Primary Examiner*—Gary L. Welch
(74) *Attorney, Agent, or Firm*—Thompson Hine LLP

(57) ABSTRACT

A garment of a type having an outer shell and an inner liner, the inner liner including an outer moisture barrier and an inner thermal barrier, in which the inner liner is constructed such that the moisture barrier is easily separable from the thermal barrier. The moisture barrier is releasably connected to the thermal barrier are about the peripheries of the thermal barrier and moisture barrier and the connections at the peripheries are designed to minimize penetration of liquid moisture from the ambient to the thermal barrier.

63 Claims, 3 Drawing Sheets

HAZARDOUS DUTY GARMENT WITH SEPARABLE MOISTURE BARRIER AND THERMAL BARRIER

BACKGROUND

The present invention relates to garments and, more particularly, to hazardous duty garments such as, for example, firefighter garments that provide flame, heat and moisture protections to a wearer.

A commonly-used type of hazardous duty garment is a firefighting ensemble. A typical firefighting ensemble comprises a turnout coat and pant, each of which has an outer shell, a moisture barrier located within the outer shell and thermal barrier. The outer shell is constructed of a flame and heat resistant material such as woven aramid and/or polybenzamidazole ("PBI," a trademark of Celanese Corp.) fibers. Commercially available aramid materials include NOMEX and KEVLAR (both are trademarks of E.I. DuPont de Nemours & Co., Inc.).

The moisture barrier typically includes a membrane layer, which is moisture vapor permeable but impermeable to liquid moisture, bonded to a substrate of a flame and heat resistant material such as the aramid material of the outer shell, only lighter in weight. The thermal barrier is typically positioned within the moisture barrier in order to prevent it from absorbing the liquid moisture that may penetrate the outer shell. The thermal barrier typically comprises a needlepunch or batting of an aramid fiber.

The moisture barrier and thermal barrier typically are permanently attached to each other about their peripheries by stitching so that they function as a unitary component of the garment and are often referred to together as the inner liner of the garment. Typically, the inner liner is removeably attached to the outer shell about its periphery by strips of hook and loop material and/or slide fasteners, snaps or buttons.

Each layer of the ensemble must meet the requirements spelled out in the National Fire Protection Association ("N.F.P.A.") standard 1971 ("Protective Clothing for Structural Firefighting") that includes standards for heat and flame resistance and tear strength. For example, an outer shell of a firefighter garment must be able to resist burning, melting, dripping and separation at a temperature of 500° F. for five minutes. The moisture barrier typically is made of expanded polytetrafluoroethylene ("PTFE") such as GORE-TEX (a trademark of W.L. Gore & Associates, Inc.). All layers combined must provide a thermal protection performance ("TPP") rating of at least 35.

Firefighter garments are designed to be worn in the hostile environment in which fires are fought. In addition to the intense heat encountered in fighting fires and the constant wetting of the garment that results from the firefighting action, the outer shell of a firefighter garment can become caked with mud or other material or may absorb other undesirable materials, some of which may be flammable, may ultimately degrade the garment or may result in permanent staining.

In addition, the thermal barrier and moisture barrier of the inner liner of the garment may absorb perspiration moisture from the wearer generated during the intense physical exertion expended during fire fighting activities. Either or both of the moisture barrier and thermal barrier also may become impregnated with liquid or other material that may impede the ability of the inner liner to function. Furthermore, either or both of the moisture barrier and thermal barrier may become damaged or worn, thus creating a breach in the protection of the inner liner. However, typically the moisture barrier possesses a shorter useful life than the thermal barrier or outer shell, thereby necessitating its repair or replacement on a more frequent basis than those other components. In addition, the moisture barrier is more difficult to repair and to seal off the repairs in order to maintain the integrity of the moisture barrier.

As a result, routine laundering and repair of firefighter garments is necessary in order to remove the undesirable materials deposited or absorbed by the outer shell as well as the inner liner or to repair rips or punctures. With present firefighter garment designs, it is possible to separate the inner liner from the outer shell so that either the inner liner or the outer shell may be laundered, repaired or replaced at one time. However, with respect to the inner liner, it is not possible to separate the moisture barrier from the thermal barrier easily; rather, it is necessary literally to deconstruct the garment by removing the stitches attaching those two components of the inner liner together—a costly and time-consuming operation.

Accordingly, both components, comprising the entire inner liner, must be removed from service together and laundered simultaneously as a unit. Since it is the moisture barrier that possesses the shortest useful life, it is the moisture barrier that requires the most frequent repair or replacement. However, since the moisture barrier is not easily and readily separable from the thermal barrier of such garments, in many cases both the thermal barrier and moisture barrier are removed from service, which increases the overall maintenance cost of the garment beyond what would result if, for example, the moisture barrier alone were to be removed. Accordingly, there is a need for a firefighter garment in which the inner liner components can be removed and repaired selectively.

SUMMARY

The present invention is a garment, which may be a hazardous duty garment, having an inner liner that includes a moisture barrier that is separable from the thermal barrier. As a result, the thermal barrier or moisture barrier may be selectively removed from service as needed and repaired. In addition, if either of the thermal barrier or moisture barrier is damaged (e.g., punctured or ripped), that component may be replaced quickly without the necessity of replacing the entire inner liner or removing the entire inner liner from service for an extended period of time.

In one embodiment, the hazardous duty garment may be in the form of a firefighter garment that includes an outer shell of a heat and flame resistant material and a removable inner liner. The inner liner includes an outer moisture barrier layer removably attached to an inner thermal barrier layer about the peripheries of the two components. The inner liner preferably may be attached to the outer shell by conventional means such as strips of hook and loop material and slide fasteners so that the entire inner liner may be removed from the outer shell easily. The moisture barrier may be removably attached to the thermal liner by strips of hook and loop material and slide fasteners.

This embodiment may take the form of various firefighter garments, such as a turnout coat, a turnout pant, jumpsuit, pullover parka and the like. Special attachment designs may be employed for the interface between the moisture barrier and thermal barrier. In one embodiment, the inner liner of the coat includes a front opening attached to the edge of the front opening of the outer shell by a slide fastener. The slide fastener may be attached to the thermal barrier that, in turn, may be attached to the moisture barrier by a slide fastener. An additional strip of moisture barrier material may overlie the slide fastener connection between the thermal barrier and moisture barrier so that the moisture-resistant integrity of the garment is not compromised along that interface.

Similarly, the collar portion of the inner liner may be attached to the outer shell by strips of hook and loop material. The thermal barrier may be attached to the moisture barrier at that point by strips of hook and loop material as well.

The hem of the inner liner may include a connecting mechanism, such as peripheral strips of hook and loop material, connecting the moisture barrier with the thermal barrier. The sleeves of the inner liner may terminate in cuffs in which the thermal barrier includes an extension releasably attached to the moisture barrier and outer shell by strips of hook and loop material. In addition, the thermal barrier may include a wristlet attached to its inner periphery. That extension preferably is comprised of a layer of face cloth material covering a layer of thermal barrier material that has low moisture absorbent characteristics, such as an apertured foam.

The objects and advantages of the present invention will be apparent from the following description, the accompanying drawings and the appended claims.

DETAILED DESCRIPTION

Figure 1:
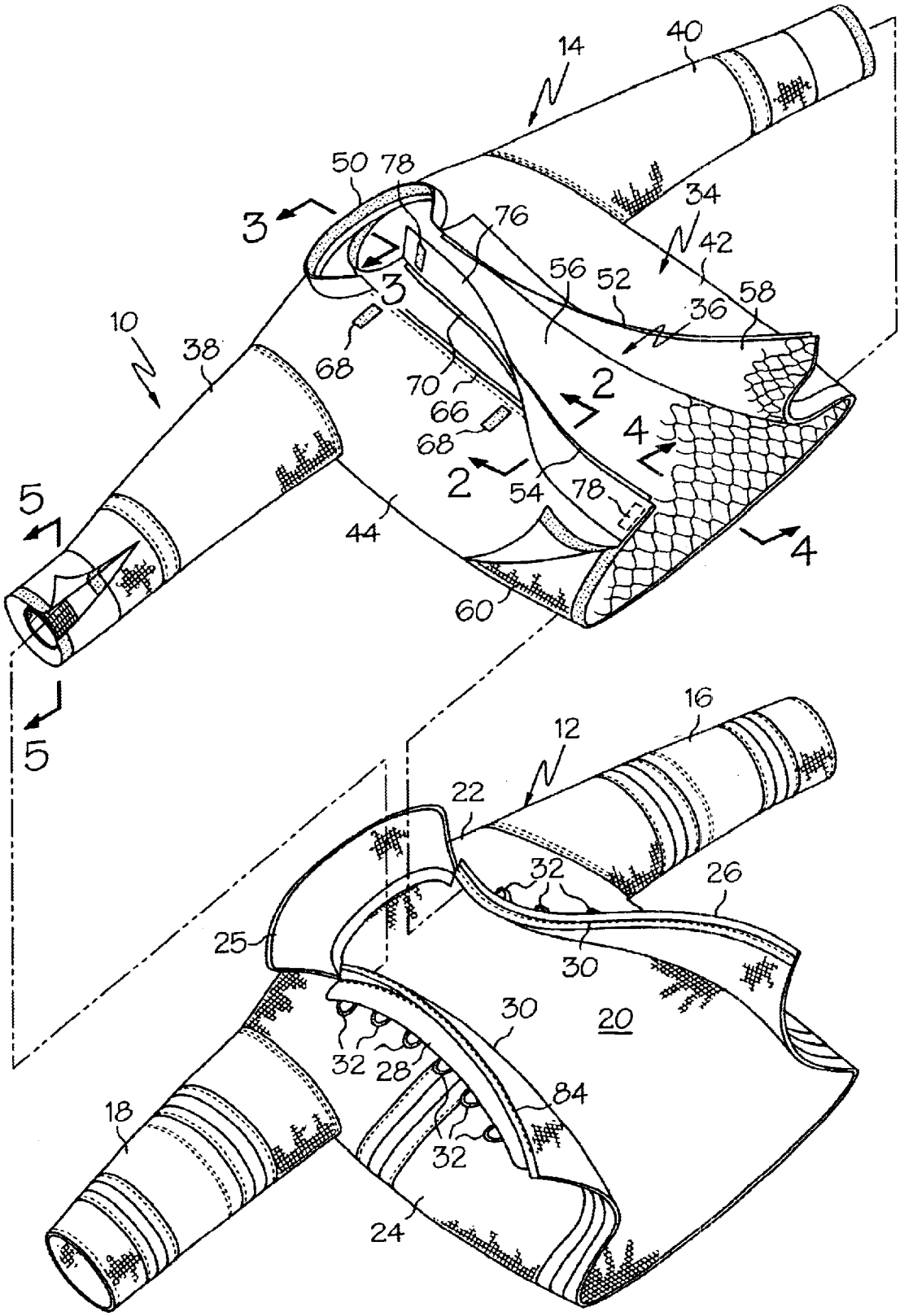
FIG. 1 is an exploded, perspective view of a preferred embodiment of the disclosed hazardous duty garment in the form of a turnout coat, in which the inner liner is shown separated from the outer shell.

A garment, such as a hazardous duty garment in the form of a firefighter garment, generally designated 10, is shown in FIG. 1. It is readily apparent to one skilled in the art that the structure of the embodiment shown and described herein is applicable to other garments that require the same or similar components. The garment 10 includes an outer shell 12 and an inner liner 14. The outer shell 12 may be made of a flame and heat resistant aramid material such as NOMEX or PBI. The outer shell 12 may be in a form of a turnout coat having sleeves 16, 18 a back panel 20 and left and right front panels 22, 24, respectively. A collar 25, made of the same outer shell material, may be attached to the front panels 22, 24 and back panel 20. The front panels 22, 24 may be permanently attached to the back panel 20 and sleeves 16, 18 and terminate in vertical front edges 26, 28. The vertical front edges 26, 28 form a front opening which may be secured by conventional means such as slide fastener components 30 and hook and D connections 32.

Figure 2:
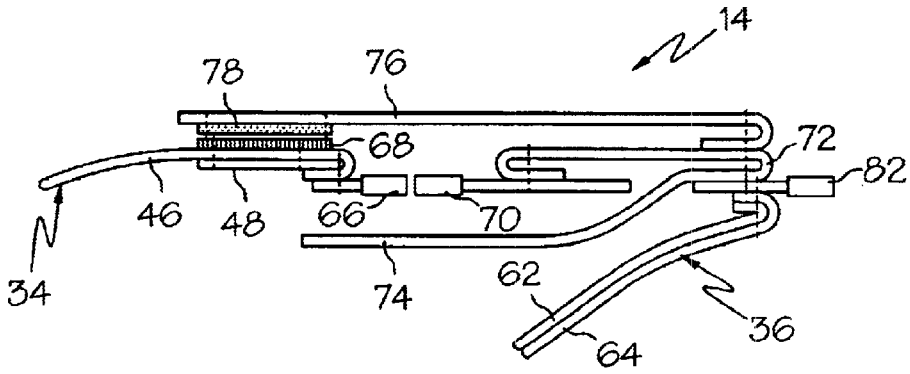
FIG. 2 is a detail sectional view taken at line 2—2 of FIG. 1.

The inner liner 14 may include a moisture barrier 34 and a thermal liner 36. The moisture barrier 34 may include sleeves 38, 40, a back panel (not shown) and left and right front panels 42, 44 respectively. As shown in FIG. 2, the moisture barrier 34 may include a layer of semi-permeable membrane material 46, such as GORE-TEX, attached to a substrate of a face cloth material 48, such as a woven aramid fiber. The moisture barrier 34 of inner liner 14 may include a collar 50 (see FIG. 1) attached to the left and right front panels 42, 44, respectively, and back panel (not shown). As with the outer shell 12, the front panels 42, 44 may terminate in a vertical front opening defined by left and right edges 52, 54, respectively.

The thermal barrier 36 may be co-extensive with the moisture barrier 34 and therefore may include opposing sleeves (not shown), a back panel 56 and left and right front panels 58, 60, respectively.

As shown in FIG. 2, the thermal barrier 36 may be comprised of an insulating layer 62 of a NOMEX batting stitched to a face cloth layer 64, which typically comprises a weave of aramid material.

The moisture barrier 34 may be easily separable from the thermal barrier 36 and the two components attached to each other about their peripheries. The manner of attachment varies depending upon the portions of the components of the moisture barrier 34 and thermal barrier 36 being attached and such mechanisms are discussed below.

As shown in FIG. 1, the front openings 52, 54 of the moisture barrier 34 and thermal barrier 36 may be attached in a manner that preserves the integrity of the moisture barrier function; that is, so that the moisture barrier 34 may prevent liquid moisture that penetrates the outer shell 12 from reaching the thermal barrier 36. Of course, should the thermal barrier become wet with liquid moisture its ability to "breathe" (i.e., transport perspiration moisture vapor outwardly away from the wearer) becomes reduced and the loft of the batting comprising the thermal barrier may become reduced as well, which would reduce the insulating capabilities of the thermal barrier.

As shown in FIG. 2, the moisture barrier 34 may terminate in a releasable connecting device such as slide fastener strip 66 and immediately adjacent to that slide fastener strip there may be a strip of hook and loop material 68. The thermal barrier 36 includes a complementary connecting device in the form of slide fastener strip 70 that may be attached to the main body of the thermal barrier by a strip of moisture barrier material 72. That same strip of moisture barrier material 72 includes a flap 74 that may be positioned to extend between the slide fastener connection formed by components 66, 70 and the main body of the thermal barrier 36. The strip 72 also may be connected to a strip 76 of moisture barrier material that extends over the opposite face of the slide fastener connection 66, 70 and includes a strip of hook and loop material 78 that may be positioned to engage strip 68. As a result, the slide fastener connection 66, 70 between the moisture barrier 34 and thermal barrier 36 may be encased in strips or flaps of moisture barrier material 74, 76. Slide fastener component 82 may be attached between the batting 62 and the moisture barrier strip 72 and connects to a complementary slide fastener strip 84 on the outer shell 12 (see FIG. 1). It is to be understood that the opposite side of the front opening of the inner liner 14 may have the same construction as between the outer shell 34 and inner liner 36.

Consequently, detachment of the moisture barrier 34 from the thermal barrier 36 at the location of the front openings 52, 54 may be easy and quick to effect. First, the strip 76 may be separated from moisture barrier 34 by parting the connections between strips 78 and 68, as shown partially in FIG. 1. Then, the slide fastener connection may be "unzipped," separating components 66 and 70.

Figure 3:
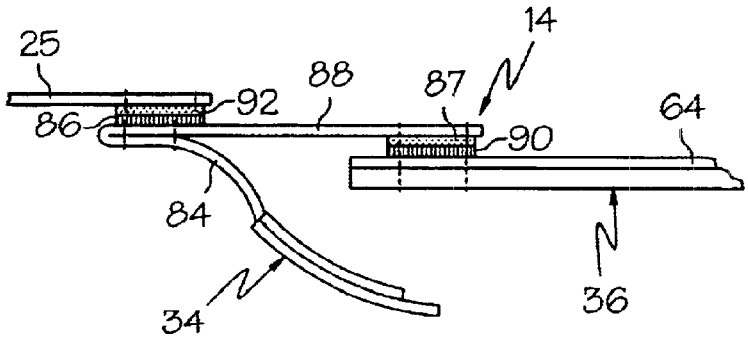
FIG. 3 is a detail sectional view taken at line 3—3 of FIG. 1.

As shown in FIG. 3, the connection between the inner liner 14 and the outer shell 12 may be shown at the area of the collar 25 of the garment 10 (see FIG. 1). The moisture barrier 34 includes an extension 84 made of moisture barrier material that may be attached to an upper end of the moisture barrier defining the neck opening of the garment. The extension 84 may include a strip 86 of hook and loop material and a connecting device in the form of a second strip 87 of hook and loop material attached to a further extension 88. The strip 87 of hook and loop material may be attached to a complementary connecting device in the form of strip 90 of hook and loop material attached to the thermal barrier 36. In the embodiment shown in FIG. 3, the strip 90 may be attached to the face cloth 64 of the thermal barrier 36. The strip 86 of hook and loop material of the extension 84 may be releasably attached to complementary strip 92 of hook and loop material attached to the upper end of the collar 25 of the outer shell 12.

In this fashion, the inner liner 14 is removable from the outer shell 12 at the neck opening by parting the strips of hook and loop material 92, 86 and further, the upper edge of the thermal barrier 36 at the neck opening may be protected and enclosed by the moisture barrier 34. Specifically, the further extension 88 may enclose the outwardly-facing portion (facing the neck of the wearer) of the upper edge of the thermal barrier 36 at the neck opening, while the upper portion of the moisture barrier 34 protects the opposite side and may be positioned to provide an interface between the thermal barrier and the outer shell at that point. In order to separate the moisture barrier 34 from the thermal barrier 36 of the inner liner 14 at the neck area, one only needs to part the strips of hook and loop material 87, 90 of the thermal barrier and moisture barrier, respectively.

Figure 4:
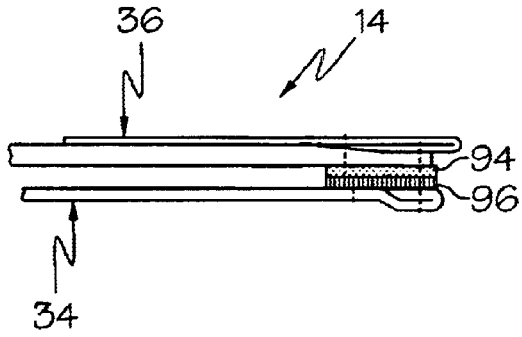
FIG. 4 is a detail sectional view taken at line 4—4 of FIG. 1.

The bottom hem of the garment 10 is shown in detail in FIG. 4. The connecting device between the moisture barrier 34 and thermal barrier 36 may comprise strips of hook and loop material that extend about the lower periphery of the inner liner 14. Specifically, strip 94 may be attached to and extend long the lower periphery of the thermal barrier 36, while complementary strip 96 of hook and loop material may extend about the lower periphery of the moisture barrier 34.

There may be no need for a hard mechanical connection between the inner liner 14 and the outer shell 12 (see FIG. 1) at this point. The inner liner 14 may be held in place with respect to the outer shell 12 by the slide fastener connection shown in FIGS. 1 and 2, as well as the engagement of the sleeves 38, 40 of the inner liner 14 with the sleeves 16, 18 of the outer shell 12 and also as a result of the engagement of the cuffs of the sleeves of the inner liner with the outer shell as shown in FIG. 5 and discussed below.

Figure 5:
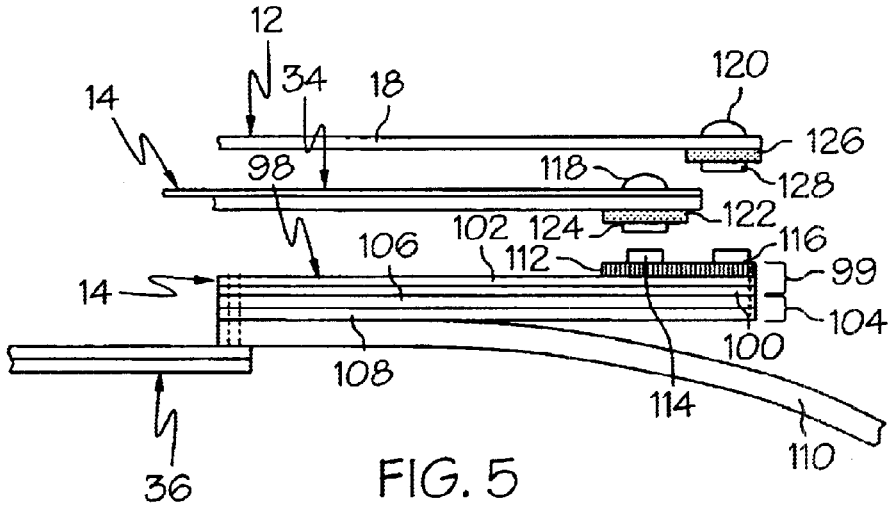
FIG. 5 is a detail sectional view taken at line 5—5 of FIG. 1.

FIG. 5 shows the connection between the inner liner 14 and outer shell 12, as well as the connection between the moisture barrier 34 and thermal barrier 36 of the inner liner. The thermal barrier 36 may include an extension cuff 98 stitched to the end of the sleeve. The extension cuff 98 may include an outer, moisture-resistant layer 99 of moisture barrier material 100 attached to a substrate 102 of aramid material. Layer 99 may be stitched to an inner layer 104 of an insulating, moisture-resistant material. An example of such a material may be a closed-cell, apertured foam 106 attached to a substrate 108 of an aramid material by a suitable adhesive. A suitable foam is disclosed in Aldridge U.S. Pat. No. 5,697,101, the disclosure of which is incorporated herein by reference. An example of such a closed-cell, apertured foam is ENSOLITE brand foam, styles IV1, IV2, IV3, IV4, IV5, GIC and IVC, manufactured by Ensolite, Inc. of Mishawaka, Ind. A characteristic inherent in such material is that when attached to a flame-retardant substrate, such as an aramid material, the combination resists melting, dripping and separating when exposed to a temperature of 500° F. for at least five minutes. A wristlet 110 made of knitted aramid material may be attached to the layer 99 and may include a thumb opening (not shown) to keep it in place on the wrist and hand of a wearer.

The substrate 102 of the layer 99 may include a strip 112 of hook and loop material and the male components 114, 116 of alignment snaps 118, 120. Moisture barrier 34 may include a complementary strip 122 of hook and loop material and female component 124 of snap 118. Similarly, sleeve 18 of outer shell 12 includes a complementary strip 126 of hook and loop material and the female component 128 of snap 120. Consequently, the extension cuff 98 of the inner liner 14 may be releasably attached to the outer shell 12 at the end of sleeve 18 by engagement of strips 126 and 112 of hook and loop material on the sleeve and extension cuff. Extension cuff 98 (and thus thermal barrier 36) may be attached to moisture barrier 34 by engagement of strips 122 and 112 of hook and loop material. Snaps 120 and 118 between the outer shell 12 and the inner liner 14 and the moisture barrier 34 and thermal barrier 36, respectively may be used primarily for alignment purposes. Of course, it is to be understood that the structure of the garment with respect to the opposite sleeve 16 of the outer shell 12 and sleeve 28 of the inner liner 14 may be of a similar construction.

With such a construction, the moisture barrier 34, including the extension 98, may be able to protect and minimize the wetting of the thermal barrier 36 at the outer end of the sleeve. To separate the moisture barrier from the thermal barrier 36 at that location may require only that the outer end strips of hook and loop material 112, 122 of the thermal barrier and moisture barrier, respectively, be parted.

As a result of the structure shown in FIGS. 1 through 5 and discussed above, the invention may provide an inner liner 14 that includes a separable moisture barrier 34 and thermal barrier 36 so that either component may be replaced or removed for repair, cleaning or replacement separately from the garment. Further, the connections between the moisture barrier 34 and thermal barrier 36 at the front opening, collar, bottom hem and cuffs are designed to facilitate the separation of the components and yet provide a connection that minimizes the penetration of liquid moisture and other contaminants from the ambient to the thermal barrier 36.

The overall ensemble of the preferred embodiment meets or exceeds the N.F.P.A. 1971 standard. Furthermore, it is to be understood that the connecting devices used to effect the releasable connection between the moisture barrier 34 and thermal barrier 36 are not limited to strips of hook and loop material. Other types of connecting devices include snaps, slide fasteners, buttons and the like.

It is to be understood that the present structure is not limited to firefighter garments in the form of a turnout coat. The same structure may be applied to the corresponding pant, jumpsuits, parka-style firefighter coats, EMS garments and the like, without departing from the scope of the invention.

While the form of apparatus disclosed herein constitutes a preferred embodiment of the invention, it is to be understood that the present invention is not limited to this precise form of apparatus, and that variations and modifications may be made therein without departing from the scope of the invention.

What is claimed is:

1. A hazardous duty garment comprising:

an outer shell made of a material resistant to flame, heat, abrasion and moisture; and an inner liner shaped to fit removably within said outer shell;

said inner liner including a thermal barrier made of an insulating material and a moisture barrier made of a moisture-resistant material, said moisture barrier being releasably attached to said thermal barrier, whereby said moisture barrier can be detached and separated completely from said outer shell and said thermal barrier to facilitate repair and replacement of said moisture barrier.

2. The garment of claim 1 wherein said inner liner extends substantially completely within said outer shell.

3. The garment of claim 1 wherein said moisture barrier encloses substantially an entire outer surface of said thermal barrier.

4. The garment of claim 1 further comprising strips of hook and loop material attached to said thermal barrier and said moisture barrier to removably secure said moisture barrier to said thermal barrier.

5. The garment of claim 1 further comprising snaps attached to said thermal barrier and said moisture barrier to removably secure said moisture barrier to said thermal barrier.

6. The garment of claim 1 further comprising a slide fastener attached to said thermal barrier and said moisture barrier to removably secure said moisture barrier to said thermal barrier.

7. The garment of claim 1 further comprising one of thermal barrier and said moisture barrier being releasably attachable to each other by a plurality of snaps and by strips of hook and loop material.

8. The garment of claim 7 wherein said snaps and strips of hook and loop material are located at sleeve portions of said garment.

9. The garment of claim 8 wherein said snaps and strips of hook and loop material attach said outer shell to said inner liner.

10. The garment of claim 1 wherein said garment is a turnout coat.

11. The garment of claim 1 further comprising strips of hook and loop material attached to said outer shell and said inner liner for removably securing said inner liner to said outer shell.

12. The garment of claim 1 further comprising snaps attached to said outer shell and said inner liner for removably securing said inner liner to said outer shell.

13. The garment of claim 1 further comprising a slide fastener attached to said outer shell and inner liner for removably securing said inner liner to said outer shell.

14. The garment of claim 1 wherein said moisture barrier includes portions around its periphery that are directly coupled to said thermal barrier and are not directly coupled to said outer shell.

15. The garment of claim 14 wherein said garment includes a front opening defined by a pair of front edges, and wherein said thermal barrier is directly attached to said outer shell at or adjacent to said front edges, and wherein at least part of said portions of said moisture barrier directly coupled to said thermal barrier and not directly coupled to said outer shell are located at or adjacent to said front edges.

16. The garment of claim 1 wherein said moisture barrier includes portions around its periphery that are directly coupled to said outer shell and other portions around its periphery that are not directly coupled to said outer shell.

17. The garment of claim 16 wherein said portions of said moisture barrier that are not directly coupled to said outer shell are directly coupled to said thermal barrier.

18. The garment of claim 17 wherein said garment includes a front opening defined by a pair of front edges, and wherein said portions of said moisture barrier that are not directly coupled to said outer shell are located at or adjacent to said front edges, and wherein said garment includes a collar, and wherein at least part of said portions of said moisture that are directly coupled to said outer shell are located at or adjacent to said collar.

19. The garment of claim 1 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer of said garment.

20. The garment of claim 1 wherein said moisture barrier, thermal barrier and outer shell cannot be assembled and releasably coupled together such that said thermal barrier is located between said moisture barrier and said shell.

21. The garment of claim 1 wherein said outer shell includes an outer shell attachment portion and said moisture barrier includes a first attachment portion that can cooperate with said outer shell attachment portion to be manually releasably coupled said moisture barrier to said outer shell, said moisture barrier including a second attachment portion, said thermal barrier including an attachment portion that can cooperate with said second attachment portion of said moisture barrier to be manually releasably coupled said thermal barrier to said moisture barrier, wherein said outer shell attachment portion, said first and second attachment portions of said moisture barrier, and said attachment portion of said thermal liner being arranged and located such that said moisture barrier, said thermal barrier and said outer shell can be releasably coupled together by said attachment portions in only a single, predetermined configurations.

22. The garment of claim 21 wherein said attachment portion of said outer shell and said first attachment portion of said moisture barrier are manually detachable, and wherein said second attachment portion of said moisture barrier and said attachment portion of said thermal barrier are manually detachable.

23. The garment of claim 21 wherein said predetermined configuration is a configuration wherein said moisture barrier is configured to be located between said outer shell and a wearer of said garment and said thermal barrier is configured to be located between said moisture barrier and a wearer of said garment.

24. A firefighter turnout coat comprising:

an outer shell made of a material resistant to flame, heat, abrasion and moisture; and an inner liner shaped to fit removably within said outer shell and extending substantially completely throughout said outer shell;

said inner liner including a thermal barrier made of an insulating material and a moisture barrier made of a moisture-resistant material, said moisture barrier being shaped to enclose substantially the entire outer surface of said thermal barrier and being releasably attached to said thermal barrier, whereby said moisture barrier can be detached and separated completely from said outer shell and said thermal barrier to facilitate repair and replacement of said moisture barrier.

25. The coat of claim 24 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer of said garment.

26. The coat of claim 24 wherein said moisture barrier, thermal barrier and outer shell cannot be assembled and releasably coupled together such that said thermal barrier is located between said moisture barrier and said shell.

27. A firefighter turnout coat comprising:

an outer shell made of a material resistant to flame, heat, abrasion and moisture; and an inner liner shaped to fit removably within said outer shell and extending substantially completely throughout said outer shell, said inner liner including a thermal barrier made of an insulating material and a moisture barrier made of a moisture-resistant material, said moisture barrier being shaped to enclose substantially an entire outer surface of said thermal barrier and being releasably attached to said thermal barrier, whereby said moisture barrier can be detached and separated completely from said outer shell and said thermal liner to facilitate repair and replacement of said moisture barrier;

said thermal barrier having sleeves terminating in extensions made of moisture-resistant material, said extensions being releasably attachable to said moisture barrier.

28. The coat of claim 27 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer of said garment.

29. The coat of claim 27 wherein said moisture barrier, thermal barrier and outer shell cannot be assembled and releasably coupled together such that said thermal barrier is located between said moisture barrier and said shell.

30. The coat of claim 27 wherein said moisture barrier can be manually detached and completely separated from said outer shell and from said thermal liner.

31. The coat of claim 27 wherein said coat further includes attachment means for releasably attaching said moisture barrier and said thermal liner, and wherein said attachment means can be manually manipulated to detach said moisture barrier and from said thermal liner and to attach said moisture barrier an said thermal liner.

32. A firefighter turnout coat comprising:

an outer shell made of a material resistant to flame, heat, abrasion and moisture; and an inner liner shaped to fit removably within said outer shell and extending substantially completely throughout said outer shell, said inner liner including a thermal barrier made of a insulating material and a moisture barrier made of a moisture-resistant material, said moisture barrier being shaped to enclose substantially the entire outer surface of said thermal barrier and being releasably attached to said thermal barrier, whereby said moisture barrier can be detached and separated completely from said outer shell and said thermal liner to facilitate repair and replacement of said moisture barrier;

said thermal barrier having sleeves terminating in extensions made of moisture-resistant material, said extensions being releasably attachable to said moisture barrier and to said outer shell.

33. The coat of claim 32 wherein said moisture barrier can be manually detached and completely separated from said outer shell and from said thermal liner.

34. The coat of claim 32 wherein said coat further includes attachment means for releasably attaching said moisture barrier and said thermal liner, and wherein said attachment means can be manually manipulated to detach said moisture barrier and said thermal liner and to attach said moisture barrier and said thermal liner.

35. A firefighter turnout coat comprising:

an outer shell made of a material resistant to flame, heat, abrasion and moisture; and an inner liner shaped to fit removably within said outer shell and extending substantially completely throughout said outer shell;

said inner liner including a thermal barrier made of an insulating material, a moisture barrier made of a moisture-resistant material and shaped to enclose substantially the entire outer surface of said thermal barrier, being releasably attached to said thermal barrier, whereby said moisture barrier can be detached and separated completely from said outer shell and said thermal barrier to facilitate repair and replacement of said moisture barrier.

36. The coat of claim 35 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer said garment.

37. The coat of claim 35 wherein said moisture barrier, thermal barrier and outer shell cannot be assembled and releasably coupled together such that said thermal barrier is located between said moisture barrier and said shell.

38. A hazardous duty garment comprising:

an outer shell made of a material resistant to flame, heat, abrasion and moisture;

an inner liner shaped to fit removably within said outer shell, said inner liner including a thermal barrier made of an insulating material and a moisture barrier made of a moisture-resistant material, said moisture barrier being releasably attached to said thermal barrier, whereby said moisture barrier can be detached and separated completely from said outer shell and said thermal barrier to facilitate repair and replacement of said moisture barrier; and said thermal barrier having a front opening defined by front edges, said front edge having a connecting device for releasable attachment to said moisture barrier and opposing strips of moisture resistant material extending along said front edge on either side of said connecting device.

39. The garment of claim 38 wherein said moisture barrier has a front opening defined by front edges coinciding with said thermal barrier front opening and said thermal barrier front edges, said moisture barrier front edges including a mating releasable connecting device positioned to engage and form a releasable connection with said connecting device.

40. The garment of claim 39 wherein said connection formed between said connecting device and said mating connecting device is enclosed between said strips of moisture resistant material.

41. The garment of claim 40 further comprising an outer connection device positioned to connect an outermost one of said strips to said moisture barrier, thereby covering said releasable connection between said moisture barrier and said thermal barrier.

42. The garment of claim 38 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer of said garment.

43. The garment of claim 38 wherein said moisture barrier, thermal barrier and outer shell cannot be assembled and releasably coupled together such that said thermal barrier is located between said moisture barrier and said shell.

44. A hazardous duty garment comprising:

an outer shell made of a material resistant to flame, heat, abrasion and moisture;

an inner liner shaped to fit removably within said outer shell, said inner liner including a thermal barrier made of an insulating material and a moisture barrier made of a moisture-resistant material, said moisture barrier being releasably attached to said thermal barrier, whereby said moisture barrier can be detached and separated completely from said outer shell and said thermal barrier to facilitate repair and replacement of said moisture barrier; and said inner liner including a collar opening, said moisture barrier having a collar portion including an extension made of moisture barrier material extending substantially about said collar opening, said extension having a connection device for releasable attachment to said thermal barrier.

45. The garment of claim 44 wherein said thermal liner includes a collar opening having a mating connecting device for releasably engaging said connecting device.

46. The garment of claim 45 wherein said collar portion extension includes a second connecting device for releasably engaging said outer shell.

47. The garment of claim 44 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer of said garment.

48. The garment of claim 44 wherein said moisture barrier, thermal barrier and outer shell cannot be assembled and releasably coupled together such that said thermal barrier is located between said moisture barrier and said shell.

49. A hazardous duty garment comprising:

an outer shell made of a material resistant to flame, heat, abrasion and moisture;

an inner liner shaped to fit removably within said outer shell, said inner liner including a thermal barrier made of an insulating material and a moisture barrier made of a moisture-resistant material, said moisture barrier being releasably attached to said thermal barrier, whereby said moisture barrier can be detached and separated completely from said outer shell and said thermal barrier to facilitate repair and replacement of said moisture barrier; and said moisture barrier and said thermal barrier each having a lower hem extending about a lower periphery thereof, said inner liner further including a manually releasable connecting device for releasably attaching said moisture barrier to said thermal barrier at said lower hems thereof.

50. The coat of claim 49 wherein said releasable connection device can be manually manipulated to attach and detach said moisture barrier to and from said thermal barrier.

51. A hazardous duty garment comprising:

an outer shell made of a material resistant to flame, heat, abrasion and moisture;

an inner liner shaped to fit removably within said outer shell, said inner liner including a thermal barrier made of an insulating material and a moisture barrier made of a moisture-resistant material, said moisture barrier being releasably attached to said thermal barrier, whereby said moisture barrier can be detached and separated completely from said outer shell and said thermal barrier to facilitate repair and replacement of said moisture barrier; and said moisture and thermal barriers each having sleeves terminating in cuffs, said thermal barrier cuff terminating in an extension made of moisture-resistant material having a connecting device for effecting a releasable connection with said moisture barrier.

52. The garment of claim 51 wherein said moisture barrier includes a complementary connecting device for releasably engaging said thermal barrier connecting device.

53. The garment of claim 52 wherein said moisture barrier includes an extension terminating in a second connecting device for effecting a releasable connection with said outer shell.

54. The garment of claim 53 wherein said moisture barrier extension is made of a moisture-resistant thermal barrier material.

55. The garment of claim 51 wherein said moisture barrier can be manually detached and completely separated from said outer shell and from said thermal liner.

56. The garment of claim 51 wherein said garment further includes attachment means for releasably attaching said moisture barrier and said thermal liner, and wherein said attachment means can be manually manipulated to detach said moisture barrier and said thermal liner and to attach said moisture barrier and said thermal liner.

57. A hazardous duty garment comprising:

an outer shell made of a material resistant to flame, heat, abrasion and moisture;

an inner liner shaped to fit removably within said outer shell; and said inner liner including a thermal barrier made of an insulating material and a moisture barrier made of a moisture-resistant material, said moisture and said thermal barriers each including complementary releasable connecting devices, whereby at least said moisture barrier can be detached and separated completely from said outer shell and said thermal barrier to facilitate repair and replacement of said moisture barrier.

58. The garment of claim 57 wherein said moisture barrier, thermal barrier and outer shell can be assembled and releasably coupled together in only a single, predetermined configuration wherein said moisture barrier is configured to be located between said outer shell and a wearer of said garment and said thermal barrier is configured to be located between said moisture barrier and a wearer of said garment.

59. The garment of claim 57 wherein said moisture barrier, thermal barrier and outer shell cannot be assembled and releasably coupled together such that said thermal barrier is located between said moisture barrier and said shell.

60. A garment comprising:

an outer shell; and an inner liner shaped to fit removably within said outer shell;

said inner liner including a first layer and a second layer, said first and second layers each including complementary releasable connecting devices, whereby at least one of said first and second layers can be detached and separated completely from said outer shell and the other of said first and second layers to facilitate repair and replacement of said one of said first and second layers.

61. The garment of claim 60 wherein said first and said second layers each provide protection from an ambient different from the other.

62. The garment of claim 60 wherein said first layer, second layer and outer shell can be assembled and releasably coupled together in only a single, predetermined configuration wherein said first layer is configured to be located between said outer shell and a wearer of said garment and said second layer is configured to be located between said first layer and a wearer of said garment.

63. The garment of claim 60 wherein said first layer, second layer and outer shell cannot be assembled and releasably coupled together such that said second layer is located between said first layer and said shell.

* * * * *